US006892855B2

(12) United States Patent
Warmenhoven

(10) Patent No.: US 6,892,855 B2
(45) Date of Patent: May 17, 2005

(54) EMBOSSED SHELL FOR SPUN MUFFLERS

(75) Inventor: John Lewis Warmenhoven, Chelsea, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 92 days.

(21) Appl. No.: 10/373,821

(22) Filed: Feb. 25, 2003

(65) Prior Publication Data

US 2004/0163885 A1 Aug. 26, 2004

(51) Int. Cl.[7] ..... F01N 7/18

(52) U.S. Cl. ..... 181/282; 181/247; 181/248; 181/212; 29/890.08; D12/194

(58) Field of Search ..... 181/282, 247, 181/248, 212; 29/890.08; D12/194

(56) References Cited

U.S. PATENT DOCUMENTS

| | | | | | |
|---|---|---|---|---|---|
| 2,151,084 | A | * | 3/1939 | Deremer | 181/282 |
| 2,484,827 | A | | 10/1949 | Harley | 181/268 |
| D165,057 | S | | 11/1951 | Deremer | D12/194 |
| 2,661,073 | A | | 12/1953 | Deremer | 181/273 |
| D180,896 | S | * | 9/1957 | Deremer | D12/194 |
| 2,835,336 | A | | 5/1958 | Deremer | 181/282 |
| 3,176,791 | A | | 4/1965 | Betts et al. | 181/260 |
| 4,860,853 | A | | 8/1989 | Moring, III | 181/282 |
| 4,909,348 | A | | 3/1990 | Harwood et al. | 181/282 |
| 4,928,372 | A | | 5/1990 | Harwood et al. | 29/890.08 |
| 4,941,545 | A | * | 7/1990 | Wilcox et al. | 181/282 |
| 5,252,788 | A | | 10/1993 | Emrick et al. | 181/282 |
| 5,448,831 | A | | 9/1995 | Harwood | 29/890.08 |

* cited by examiner

*Primary Examiner*—Shih-Yung Hsieh
(74) *Attorney, Agent, or Firm*—Harness, Dickey & Pierce, P.L.C.

(57) ABSTRACT

An exhaust muffler with a single-wall shell having a first end and a second end features a plurality of embossments formed on the shell and extending from the first end of the muffler to the second end of the muffler. The embossments are arranged in a pattern such that any straight line extending from the first end to the second end intersects at least one of the embossments, thereby imparting increased stiffness to the muffler shell. Each of the embossments preferably have an elliptical shape and are arranged in rows extending substantially parallel to a longitudinal axis of the muffler. The embossments in any given row are rotated ninety degrees from the embossments in preceding and succeeding rows and are spaced to provide an interlocking pattern.

6 Claims, 2 Drawing Sheets

EMBOSSED SHELL FOR SPUN MUFFLERS

FIELD OF THE INVENTION

The present invention relates to exhaust mufflers and more particularly to an exhaust muffler having a plurality of embossments formed thereon.

BACKGROUND OF THE INVENTION

Exhaust mufflers are well known in the art, and are used with any number of conventional combustion engines. The typical exhaust muffler is a spun-head, wrapped muffler generally formed in a cylindrical shape. The muffler shell is wrapped around a number of internal baffles and the shell is bounded on either end of the muffler by metal plates or heads. The muffler usually takes the shape of a circular cylinder or an elliptical/oval cylinder. The wrapped shell is conventionally comprised of either a single layer of metal or a bi-layer metal laminate.

Every engine while firing produces a range of resonant frequencies up to a maximum resonant frequency. These resonant frequencies are in turn transferred to the muffler. The maximum resonant frequency of the engine, if greater than the natural resonant frequency inherent in any particular muffler design, can lead to the muffler vibrating and producing "shell ring" when the resonant frequency of the engine matches the natural frequency of the muffler. This shell ring can damage the muffler and contribute to environmental noise pollution.

In circular cylindrical mufflers, shell ring is generally not an issue since the geometry of the circle lends structural strength to the muffler shell along its surface. This tends to produce higher natural resonant frequencies than the firing frequencies of engines produced by most global mass-production vehicle manufacturers. However, elliptical/oval mufflers do not typically share in the inherent geometric stiffness of the circle. The natural resonant frequencies of these mufflers tend to fall within the range of engine firing frequencies, making the muffler susceptible to resonating. Elliptical/oval mufflers with single-wall shells are particularly susceptible to shell ring since they inherently posses a low natural resonant frequency. However, use of a bi-layer shell lowers the sensitivity of the shell resonant frequency to the engine firing frequency, allowing for the use of flat-sided elliptical/oval mufflers.

While bi-layer laminated shells possess superior vibration resistance, they have some limitations. Typical bi-layer laminated shells are prone to short lives, anywhere from 3 to 4 years compared with the 5 to 7 year life-span of a single-wall shell. This shortened life-span for bi-layer laminated shells is due to accelerated corrosion. Water vapor condenses in the spaces between the lamina since these spaces are not able to vent to the atmosphere. This water entrapment accelerates the corrosion of the shell, causing earlier failure. The single-wall shell has no spaces in which vapor can condense and is therefore not susceptible to accelerated corrosion.

There remains a need in the art for an elliptical/oval exhaust muffler that combines the longevity of the single-wall shell with the resistance to shell ring of the bi-layer laminated shell. Accordingly, it is an object of the present invention to provide an elliptical/oval exhaust muffler having a single-wall shell with a natural resonant frequency greater than the maximum resonant frequency of an engine.

SUMMARY OF THE INVENTION

An exhaust muffler having a stiffened shell is provided. The exhaust muffler includes a single-wall shell having a first end and a second end. A plurality of embossments are formed on the shell and extend from the first end of the muffler to the second end of the muffler. The embossments are arranged in a pattern such that a straight line extending from the first end to the second end intersects at least one of the embossments, thereby imparting increased stiffness to the muffler shell.

In the particular example provided, each of the embossments have an elliptical shape and are arranged in rows extending from the first end to the second end of the muffler. The embossments in any given row are rotated ninety degrees from the embossments in preceding and succeeding rows and are spaced to provide an interlocking pattern.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
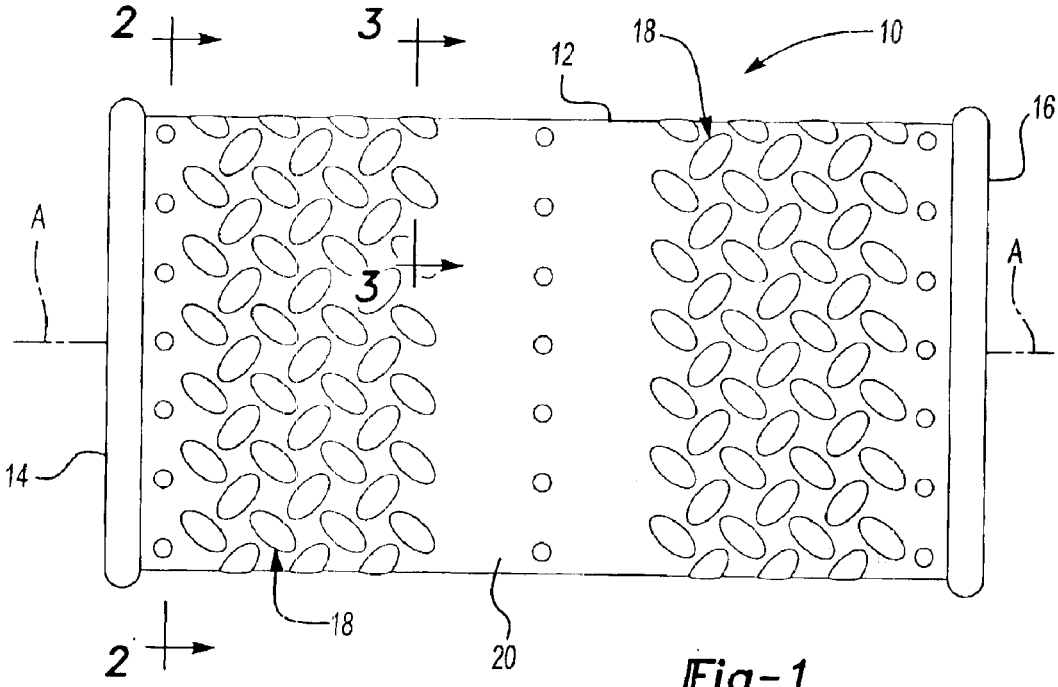
FIG. 1 is a side view of an exhaust muffler according to the principles of the present invention.
Figure 2:
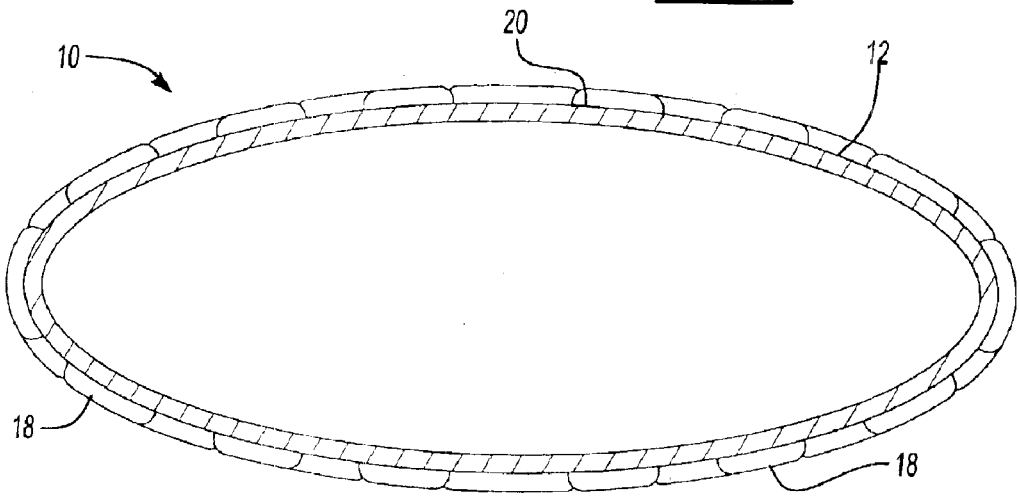
FIG. 2 is a cross-sectional view of the exhaust muffler taken along line 2—2 of FIG. 1.

Referring generally to FIGS. 1 and 2, an exhaust muffler constructed in accordance with the teachings of the present invention is generally indicated by reference numeral 10. In the particular example provided, the exhaust muffler 10 is shown to include a shell 12 with a first end 14 disposed longitudinally opposite a second end 16. The shell 12 has an elliptical cross-section as best seen in FIG. 2. As will be appreciated by those skilled in the art, various other cross-section geometries for the shell 12 may be employed. The shell 12 is constructed of a single-wall metal having a given thickness, designated as $t_1$ in FIG. 3. The exhaust muffler 10 includes inlet and outlet ports (not shown) for receiving and expelling the exhaust from a combustion engine, as is well known in the art.

Figure 3:
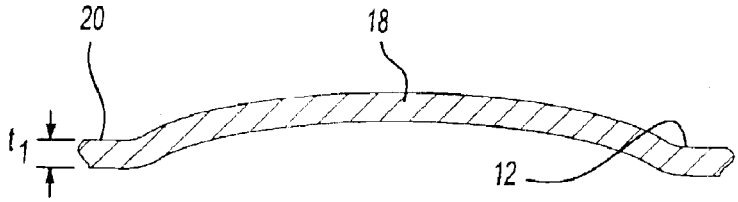
FIG. 3 is a cross-sectional view of an embossment formed on the exhaust muffler taken along line 3—3 of FIG. 1.

The exhaust muffler 10 further includes a plurality of embossments 18 formed on shell surface 20 of the shell 12. As best seen in FIG. 3, the embossments are raised to a height from shell 12. Embossments 18 are stamped or pressed into the shell 12 before assembly of the exhaust muffler 10. The height of the embossments 18 can range from approximately one-half of thickness $t_1$ of the shell 12 but should not exceed twice the thickness $t_1$ of the shell 12.

Figure 4:
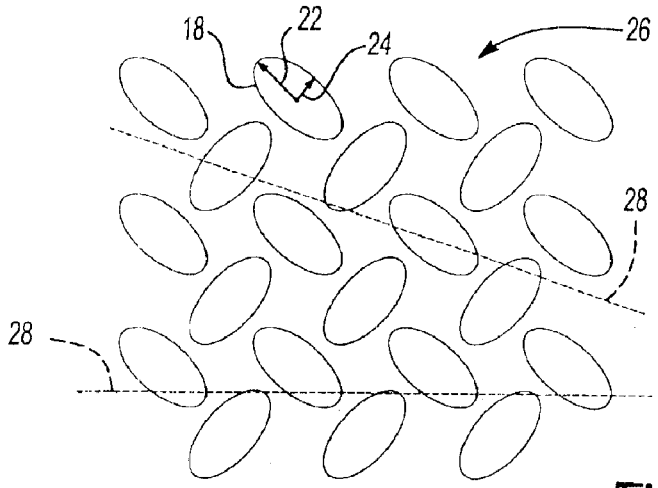
FIG. 4 is a flat view of an interlocking pattern of embossments formed on the exhaust muffler according to the principles of the present invention.

Embossments 18 preferably have an elliptical shape when viewed perpendicular to the shell surface 20. As best seen in FIG. 4, each elliptical embossment 18 has a major radius 22 and a minor radius 24, the major radius 22 being greater than the minor radius 24. This elliptical shape of embossments 18 provides an interlocking pattern, as will be described in greater detail below, while simplifying the pressing or stamping onto shell surface 20. However, any particular shape for embossments 18 may be employed.

Referring now to FIG. 4, embossments 18 formed in shell surface 20 are arranged in an interlocking pattern, generally designated by reference numeral 26. Specifically, embossments 18 are arranged in rows extending substantially parallel to a longitudinal axis A—A of the exhaust muffler 10 from the first end 14 to the second end 16 and extending circumferentially around the shell 20. Embossments 18 in any given row are rotated approximately ninety degrees to embossments 18 in preceding and succeeding rows. Rows of embossments 18 are arranged relative to one another such that the major radii 22 of an embossment 18 in any given row interlocks with the major radii 22 of an embossment 18 in preceding and succeeding rows, thereby forming the interlocking pattern 26. This interlocking pattern 26 provides that any straight line, for example dashed lines indicated by reference numeral 28 shown in FIG. 4, extending from the first end 14 to the second end 16 of the exhaust muffler 10 must intersect at least one embossment 18. Any interlocking pattern of embossments 18 may be formed on the shell 20 so long as any straight line extending from the first end 14 to the second end 16 of the muffler 10 intersects at least one embossment 18. The interlocking pattern 26 of embossments 18 provides stiffness to the exhaust muffler 10 and increases the natural resonant frequency of the exhaust muffler 10 to a value greater than the resonant frequency of an engine.

Figure 5:
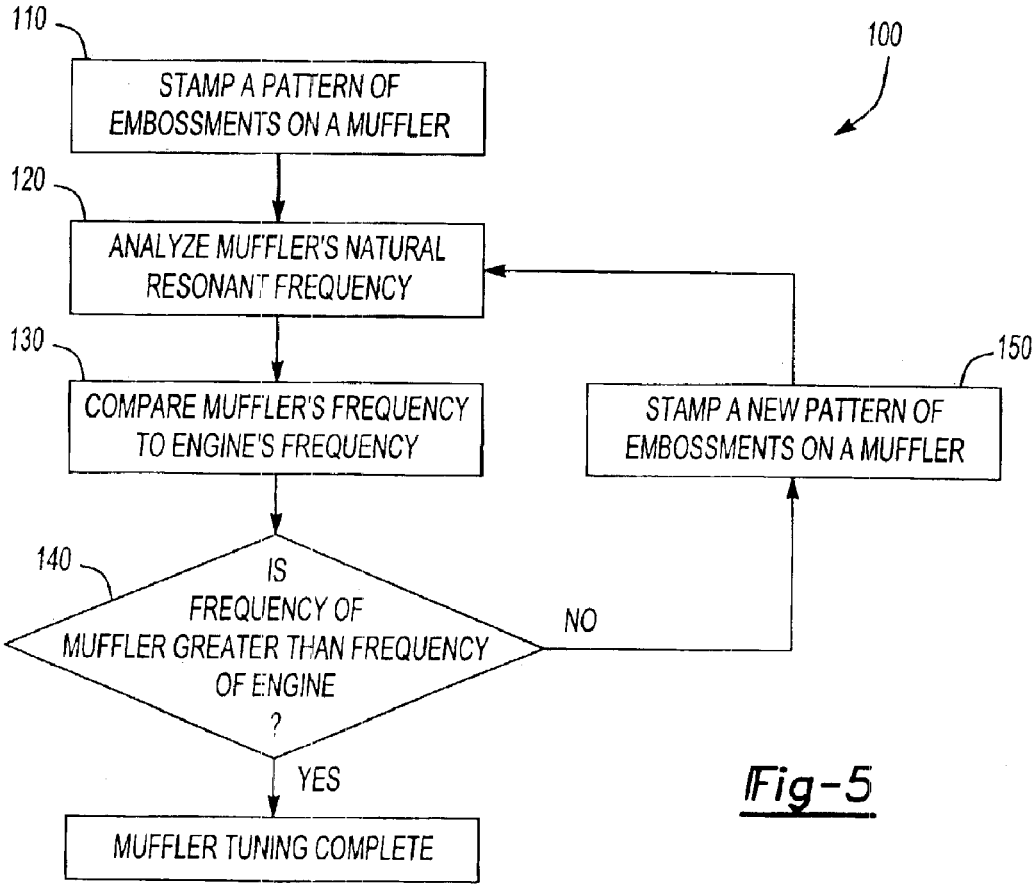
FIG. 5 is a flow diagram of a method for designing an exhaust muffler according to the principles of the present invention.

In order to tune the natural resonant frequency of the exhaust muffler 10 to a value greater than the resonant frequency of a particular engine, a method 100 for designing an exhaust muffler will now be described, with particular reference to FIG. 5. First, a muffler having a single-wall shell is provided and stamped with a plurality of embossments, step 110. The plurality of embossments are stamped in a first pattern to a first height. The muffler is then analyzed to determine its natural resonant frequency, shown in step 120. This natural resonant frequency specific to this muffler having the first pattern of embossments with the first height is then compared to the resonant frequency of the engine, shown at step 130.

If the natural resonant frequency of the muffler is greater than the resonant frequency of the engine, shown at step 140, the design is complete and the design method 100 ends. However, if the natural frequency of the exhaust muffler is approximately equal to or less than the resonant frequency of the engine, step 140, either a new pattern of embossments or embossments having a new height, or both, are formed in an exhaust muffler in step 150. The method is then repeated at step 120 until the natural frequency of the muffler is greater than the resonant frequency of the engine. In this way, any exhaust muffler can be tuned to any particular engine such that the exhaust muffler's natural resonant frequency is made higher than the engine's resonant frequency, thereby preventing muffler shell ring.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An exhaust muffler comprising:

a muffler shell including a first end and a second end; and a plurality of elliptically shaped embossments formed on said muffler shell extending from said first end to said second end and arranged in rows extending substantially parallel to a longitudinal axis of the exhaust muffler, said embossments in any given row rotated on the order of ninety degrees to said embossments in preceding and succeeding rows, said plurality of embossments arranged in a pattern such that a line extending from said first end to said second end intersects at least one of said embossments, thereby increasing the stiffness of said muffler shell.

2. The exhaust muffler of claim 1, wherein said embossments have a height from a surface of said muffler shell of approximately less than twice the thickness of said muffler shell.

3. A method for designing an exhaust muffler having a natural resonant frequency higher than the resonant frequency of an engine, the method comprising the steps of:

(a.) providing a single-shell muffler;

(b.) stamping a plurality of embossments onto said single-shell muffler in a first pattern, said embossments having a first depth;

(c.) analyzing said single-shell muffler to determine a natural resonant frequency of the single-shell muffler;

(d.) comparing said natural resonant frequency of said single-shell muffler to the resonant frequency of the engine, and if said natural frequency of said single-shell muffler is approximately less than or equal to said resonant frequency of the engine, stamping a second plurality of embossments onto a second single-shell muffler, said embossments having a second pattern or a second depth, and repeating steps (c.) and (d.) until the natural resonant frequency of said muffler exceeds the resonant frequency of the engine.

4. An exhaust muffler comprising:

a muffler shell; and a plurality of embossments, each having a major axis and a minor axis smaller than the major axis, formed on the muffler shell and arranged in rows extending substantially parallel to a longitudinal axis of the exhaust muffler, the embossments in any given row having major axes rotated from major axes of embossments in preceding and succeeding rows.

5. The exhaust muffler of claim 4 wherein the embossments in any given row have major axes rotated on the order of ninety degrees from major axes of embossments in preceding and succeeding rows.

6. The exhaust muffler of claim 4 wherein the embossments are elliptical.

* * * * *